United States Patent [19]

Martinez

[11] 4,223,541

[45] Sep. 23, 1980

[54] RING WITH INTERNAL MEANS FOR VARYING SIZE

[76] Inventor: Luis M. Martinez, 23871 W. LeBost Dr., Novi, Mich. 48050

[21] Appl. No.: 916,011

[22] Filed: Jun. 15, 1978

[51] Int. Cl.[3] ..... A44C 9/02

[52] U.S. Cl. ..... 63/15.6; 308/244

[58] Field of Search ..... 63/15.6, 15.65; 308/244

[56] References Cited

U.S. PATENT DOCUMENTS

| | | | |
|---|---|---|---|
| 152,789 | 7/1874 | Annin | 63/15.6 |
| 248,337 | 10/1881 | Missimer | 63/15.6 |
| 512,839 | 1/1894 | Oppenheimer | 63/15.6 |
| 1,115,764 | 11/1914 | Applas | 63/15.6 |
| 1,278,047 | 9/1918 | Smith | 63/15.6 |
| 1,442,738 | 1/1923 | Seeler | 63/15.6 |
| 1,999,868 | 4/1935 | Coultas | 308/244 X |
| 3,460,356 | 8/1969 | Lodrini | 63/15.6 |
| 3,483,718 | 12/1969 | Lodrini | 63/15.6 |

FOREIGN PATENT DOCUMENTS

| | | | |
|---|---|---|---|
| 2657838 | 6/1978 | Fed. Rep. of Germany | 308/244 |
| 907191 | 6/1945 | France | 63/15.6 |
| 1191407 | 4/1959 | France | 63/15.6 |

*Primary Examiner*—F. Barry Shay
*Attorney, Agent, or Firm*—Jay C. Taylor

[57] ABSTRACT

An ornamental finger ring having in-built adjusting band enclosed within an interior slot in the shank and movable therein to constrict the opening and provide a plurality of selectable smaller finger openings to insure a snug fit and concurrently preserve the external appearance and contour of the ring. The band is detachably secured to the ring by latching means on the shank and band and has a tab projecting through an exteriorly opening tab slot in the shank by means of which it can be adjusted. The band latching means are carried at the ends of reversely bent resilient arms.

11 Claims, 6 Drawing Figures

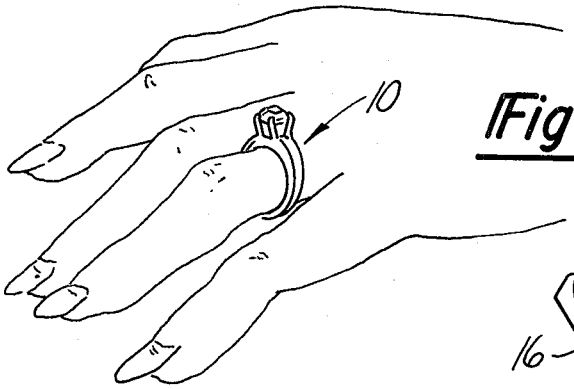
Fig-1
Fig-2
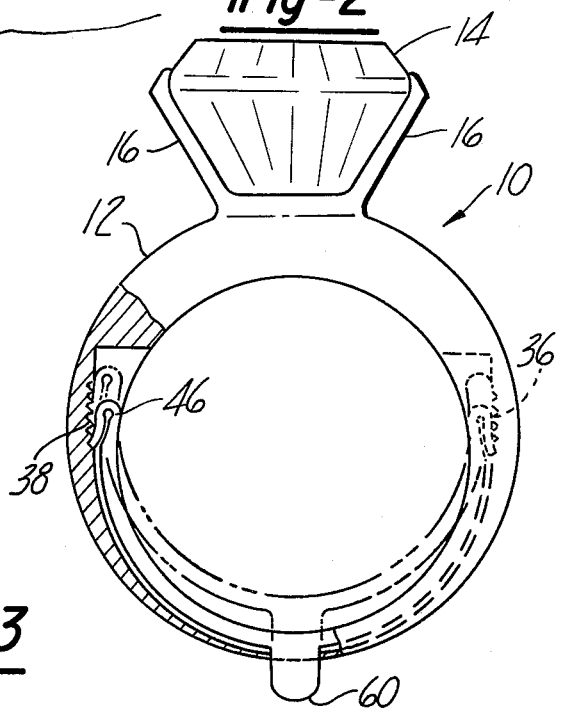
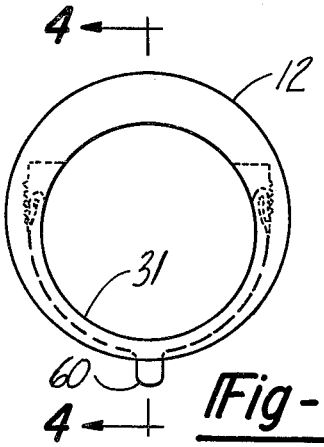
Fig-3
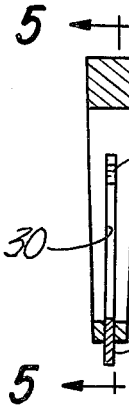
Fig-4
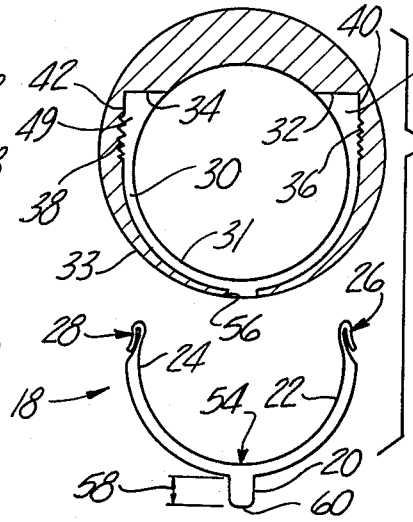
Fig-5
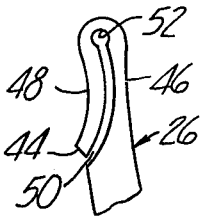
Fig-6

RING WITH INTERNAL MEANS FOR VARYING SIZE

BACKGROUND OF THE INVENTION

This invention relates to an ornamental finger ring provided with means for adjusting the finger opening size to insure a snug fit during regular wear and to accommodate easy and comfortable passing of the band over the enlarged knuckle as the ring is placed on the finger of the wearer.

It has long been recognized that the knuckle of the ring finger is larger than the phalanx or shank of the finger bone, plus the muscle and skin thereon, closest to the palm. In persons afflicted with arthritis the size difference is sometimes so great that it is virtually impossible for the arthritic person to wear an ornamental finger ring comfortably. The problem is that an ornamental ring shank having a sufficiently large opening to pass over an arthritic knuckle is so loose on the finger when in normal wearer position adjacent to the palm that it rotates on the finger to an undesirable position which interferes with ordinary use of the hand and too often fails to maintain the setting in an upright, exposed position.

The problem is one of long standing and many proposals for constricting the ring band after it has been slipped over the knuckle have been made. In the 1874 U.S. Patent to Annin, No. 152,789, a clip on filler secured by clips embracing the edges of the ring and pressed into indentations in the inner face of the ring was proposed and patented.

Other devices directed toward solving the same problem are disclosed in U.S. Pat. Nos. 3,218,826, 3,360,959 and 3,483,718; all of these devices constrict the opening in the band but provide externally visible, band-contour-changing add on means which detrimentally affect the ornamental appearance of the ring. Other references known to applicant which appear to be less pertinent include U.S. Pat. Nos. 2,281,231 and 3,204,426.

The primary object of this invention is to provide an ornamental ring having internal means for adjusting the size of the finger opening, after passing over the knuckle, to a selectable, comfortable snug fit without unsightly external projections or detrimental effect on the ornamental appearance of the ring either in the show case or on the hand of the wearer.

A secondary object is to provide means for adjusting the size of the finger opening in an ornamental ring having a conventional-appearing circular band which is easily and positively adjustable by the wearer to constrict the opening or increase its size for removal of the ring over a knuckle.

DESCRIPTION OF THE DRAWINGS

FIG. 1 illustrates the improved adjustable ring of this invention on the hand of a wearer;

FIG. 2 is a view, partly in section, showing an ornamental ring having the adjustable band therein and illustrating the showcase position of the adjustable band in solid lines and the location of the band position when on the finger of a wearer in dotted lines.

FIG. 3 illustrates a shank which includes the internal adjustable band feature of this invention and which is adaptable to form an ornamental ring by the addition of a selected setting;

FIG. 4 is a view taken along the line 4—4 of FIG. 3;

FIG. 5 is a vertical section of the shank along the line 5—5 of FIG. 4 in exploded form, showing the adjustment band prepared for assembly; and FIG. 6 is an enlargement showing the detail of the preferred locking tab on the upper end of the adjustment band.

DETAILED DESCRIPTION OF THE INVENTION

The ornamental adjustable ring of this invention generally designated 10, comprises a shank 12 having a setting 14 supported in conventional tines 16 and an adjustment band of U-shape and generally designated 18, see FIG. 5. Band 18 is provided with a tab 20 located centrally in the bight portion of the band and each arm 22,24 terminates at its upper end portion in a lock means, or ratchet member, 26, 28 respectively.

Shank 12 is provided with a relatively narrow slot 30 located centrally of the width of shank 12. Slot 30 opens through the interior surface 31 and is spaced inwardly from the external surface 33 of shank 12, as shown. Slot 30 extends from end surface 32 which is adjacent to and spaced from the right hand side of setting 14 around the bight portion of shank 12 to end surface 34. The ends 32, 34 of slot 30 are located above a horizontal plane extending through the diameter of shank 12 a selectable distance sufficient to accommodate the number of serrations 36, 38 which are located in the upper end portions of wall surface 40, 42 respectively.

Wall surfaces 40, 42 preferably form a right angle with end surfaces 32, 34 respectively to thereby provide opposing pairs of serrations 36, 38 at the same level to receive the beveled end surface 44 of ratchet members 26 and 28. Vertical wall surfaces 40, 42 and serrations 36, 38 thereon thus provide positive locking at the level of each pair of opposed serrations. Additionally, as ratchet members 26, 28 move upwardly to a new locking position the inner arm 46 adjacent the upper end lies within the arc of curvature of slot 30 and does not protrude inwardly to contact the wearer's finger or produce an unsightly appearance. The distance of end surfaces 32, 34 above the uppermost serration 36, 38 is approximately equal to the vertical height of locking arm 48 so that members 26, 28 nest in space 49 defined by inner shank surface 31, end walls 32, 34 and serration containing walls 40, 42.

It is to be understood that the length of spring ratchet member arm 48 shown in FIG. 6 is illustrative only and may be shortened or lengthened, as needed, to provide more or less serrations and free vertical space above the uppermost serration and surfaces 32 and 34.

Arm 48 is separated from inner arm 46 by slot 50 which terminates at its inner end in aperture 52. The curvature of arm 48, width of slot 50 and size of aperture 52 are selected so as to provide the needed spring, or elasticity, characteristics to cause the end surfaces 44 of arms 48 to seat snugly against a pair of serrations 36, 38 and remain in place during normal wearing of the ring. On the other hand, the degree of elasticity, or strength, of arm 48 is such as to allow relatively easy disengagement from a pair of opposed serrations when downward force is applied to the bight portion of adjustable band 18 at the arrow 54 to thereby cause tapered surface 44 to spring inwardly to permit slidable disengagement from the serrations, as best seen in FIG. 2. Any material possessing the desired strength and elasticity characteristics may be used such as white or yellow gold or silver and alloys thereof, stainless steel, or the like; particularly good results are obtained with hard dental gold alloys.

Inwardly open slot 30 is provided, at a location opposite from setting 14, with slot 56 which extends through the exterior surface 33 of shank 12. Slot 56 is located centrally of the width of the shank at its bight portion as may be seen in FIG. 4. Slot 56 is adapted to receive tab 20 with a sliding fit such that tab 20 fills the slot when the adjustable band 18 is in its normal inserted position for normal snug fit on the finger of the wearer as shown in dotted lines in FIG. 2. The length of tab 20, as indicated at 58 in FIG. 5, is substantially similar to the vertical length of serrations 36, 38 as the ring, or shank, is made and provided to jewelers for showcase display. The length 58 of tab 20 may remain the full length to provide the maximum amount of constriction of the opening in shank 12 for those customers having substantial knuckle enlargement and a small phalanx. Alternately tab 20 may be shortened by the jeweler to fit fingers requiring less constriction to a length such that the outer end surface of tab 20 lies in the surface of curvature of shank 20 when the adjustable band 18 is in its normal wearer position. In either instance, the external surface 60 of tab 20 is preferably rounded to the curvature of shank 20 such that it does not protrude when in normal wearer position.

Adjustable bands 18 and shanks 12 are separately fabricated in a plurality of sizes of finger opening and lengths 58 for tab 20. The adjustable ring or shank of this invention is formed when band 18 is assembled into slot 30 in shank 12 by positioning tab 20 into the inner end of slot 56 and slightly compressing arms 22 and 24 to enable snapping them into place such that ratchet members 26, 28 engage serrations 36, 38.

A preferred embodiment of the ring or shank shown in FIGS. 2 and 5, respectively, has four or five serrations providing a vertical travel of surface 44 on ratchet members 26, 28 of 3.7–3.8 millimeters. This length of adjustment has been found to be adequate to accommodate extreme knuckle enlargements and provide a snug fit during normal wear. The constriction of the ring opening resulting from vertical movement of the bight portion of band 18 as ratchet members 26, 28 move from the lower to the uppermost pair of serrations is somewhat less than the vertical bottom to top length of the serrations. Experience has shown that constriction equal to three or four ring sizes, as measured by United States standard ring size mandrels, is sufficient and diameter constrictions from No. 9 ring size to No. 5 ring size is 3.2 millimeters whereas constriction from No. 9 ring size to No. 6 ring size is 2.35 millimeters. Tab length 58 of 3.75±0.05 millimeters provides adequate tab length to allow the jeweler to fit the ring or shank of this invention to individual customer needs.

Placing the ring of this invention on the finger of a wearer is easily accomplished by the wearer by first applying force at arrow 54 to position band 18 entirely within slot 30 with maximum extension of tab 20 outside the arc of curvature of shank 12 as shown in solid lines in FIG. 2. The wearer then inserts the ring finger by passing the ring over the knuckle and into place adjacent the palm. The wearer then presses the exterior surface 60 of tab 20 against any flat surface to force tab 20 inwardly until the exterior surface 60 lies in the arc of curvature of shank 12, as shown in dotted lines in FIG. 2. The inward motion causes ratchet members 26, 28 to move upwardly and successively pass over serrations 36, 38 to reach the locked in place position shown in the upper dotted line position in FIG. 2.

It will be appreciated that the above described embodiments provide an easily adjustable ring, or shank, to accommodate arthritic, or enlarged, knuckles in a construction free of unsightly external projections such that the overall appearance on the hand of the wearer is that of a non-adjustable ring.

What is claimed is:

1. An ornamental finger ring comprising a setting, a generally circular primary shank having an inwardly opening slot recessed in the inner wall thereof and spaced from the exterior surface thereof, means opposite the bight of said shank for securing said setting on said shank, said slot extending around the bight portion of said shank and terminating adjacent said setting on each side thereof and having an externally opening tab slot therein located opposite said setting, a U-shaped adjustment band adapted to fit in said slot in said primary shank for movement therein between a lower position to effect a maximum finger opening for the ring and a selected upper position whereat the bight of the band is spaced inwardly of the ring from the bottom of the inwardly opening slot and whereat portions of the inner surface of the band extend inwardly of the inner circumference of said shank to provide a desired constriction for said finger opening, said adjustment band at said lower position of maximum finger opening lying entirely within said slot, latching means in said inwardly opening slot adjacent the ends thereof, latching means on said adjustment band on each side of said U shape adapted to coact with said latching means in said slot for detachably securing said band to said shank and for securing said band in said selected position, and means for enabling the exertion of force against said band from the exterior of said ring to move the band toward said selected position comprising a tab of the band dimensioned to move radially through the tab slot beyond the adjacent outer surface of said shank when the band is below said selected upper position.

2. The combination according to claim 1, the base of the slot in said shank extending arcuately around the bight of the shank and terminating in parallel upright portions at opposite sides of the setting, and said parallel portions having a plurality of vertically spaced latching means for selectively engaging said latching means of the band.

3. The combination according to claim 2, said parallel portions extending upright above the horizontal diameter of the shank, the latching means on said shank comprising a plurality of pairs of latching elements, the latching elements of each pair being at said opposite sides respectively and being at the same level above said bight, the space between the elements of each pair being the same as the corresponding space between each other pair.

4. An ornamental finger ring comprising a setting, a generally circular primary shank having an inwardly opening slot recessed in the inner wall thereof and spaced from the exterior surface thereof, means opposite the bight of said shank for securing said setting on said shank, said slot extending around the bight portion of said shank and terminating adjacent said setting on each side thereof and having an externally opening tab slot therein located at said bight, a U-shaped secondary band adapted to be removably inserted into said inwardly opening slot for detachable attachment in said primary shank for sliding movement therein toward and from said bight and having a tab dimensioned to fill said tab slot and slidable radially therein, said secondary band at said lower position of maximum finger opening lying entirely within said slot, latching means in said slot located adjacent to and spaced from each side of said setting, latching means on each side of the upper end portion of said secondary band adapted to coact with said latching means in said slot to adjustably secure said secondary band in a selected one of a plurality of positions constricting the size of the opening in said primary shank, said tab being dimensioned to extend radially beyond the adjacent outer surface of said shank when said band is below said selected position.

5. A ring in accordance with claim 4 wherein the length of said tab is adapted to be altered whereby said length may provide the desired constriction of the opening in said shank when the exterior surface of said tab lies in the surface of curvature of the exterior surface of said shank.

6. The combination in improved adjustment means for an ornamental finger ring, comprising a generally circular primary shank having a location for a setting on an upper exterior portion thereof and an inwardly opening slot recessed in the inner wall thereof and spaced from the exterior surface thereof, the slot extending around the bight of the primary shank and terminating at opposite sides of the setting location, a generally U-shaped adjustment band adapted to yield resiliently to fit in the slot for movement therein between a lower position whereat the band is substantially contained within the slot to effect a maximum finger opening for the ring and a selected upper position whereat the bight of the band is spaced inwardly from the bottom of the slot and portions of the inner surface of the band extend inwardly of the inner circumference of the shank to restrict the finger opening, the shank having a tab slot extending radially therethrough at its bight, latching means on the shank at each side thereof within said inwardly open slot and on said band at each side thereof for detachably securing together said band and said shank and interengageable at said selected position for latching said band thereat, and means for enabling the exertion of force against the band from the exterior of the ring for moving the band to the selected position comprising a tab of the band dimensioned to fill said tab slot and to move radially through the tab slot beyond the adjacent outer surface of the shank when the band is below said selected upper position and to lie flush with said outer surface when said band is at said selected position.

7. The combination in improved adjustment means for an ornamental finger ring, comprising a generally circular primary shank having a location for a setting on an upper exterior portion thereof and an inwardly opening slot in the inner wall thereof, the slot extending around the bight of the primary shank and terminating at opposite sides of the setting location, means for selectively restricting the finger opening for the ring comprising a generally U-shaped adjustment band adapted to yield resiliently to fit in the slot and being movable therein between a lower position and a selected upper adjusted position spaced inwardly from the bottom of the slot, the shank having latching means within the slot, the band having resilient latching means adjacent its upper U-ends for resiliently engaging and releasably latching with the latching means of the shank when the band is at the selected position, the latching means of the shank comprising surfaces slidably engaging the latching means of the band for urging the band upwardly to the selected position against force tending to move said band downwardly from said selected position, and means resiliently connecting the latching means of the band with the band for enabling limited inward yielding of the U-ends independently of the latching means of the band when the latter resiliently engages the latching means of the shank.

8. The combination according to claim 7, the latching means of the band comprising a pair of latching members associated with the U-ends respectively and located outwardly therefrom for resiliently engaging and yieldably latching with the latching means of the shank.

9. The combination in accordance with claim 7, the shank having adjacent its bight a tab slot extending radially therethrough, and means for enabling the exertion of exterior force against the band to move the latter upwardly to the selected adjusted position comprising a tab of the band dimensioned to extend movably through the tab slot below the exterior surface of the shank when the band is below said selected position.

10. The combination in improved adjustment means for an ornamental finger ring comprising a generally U-shaped adjustment band adapted to yield resiliently for assembly within the inner circumference of the shank for the ring at a selected position spaced above the bight of the shank for restricting the finger opening and to be movable from the selected position toward said bight, the band having a latching member associated with a U-arm and located outwardly therefrom for resiliently engaging the latching means of the shank with outwardly directed force and releasably latching therewith when the band is assembled at the selected position, and means resiliently connecting the latching member with its associated U-arm for enabling limited inward yielding of the U-arm independently of the latching member when the latter resiliently engages the latching means of the shank.

11. The combination according to claim 10, a separate latching member associated with each U-arm and each latching member comprising an arm resiliently secured at an upper end to the associated U-arm and extending downwardly to a free end located outwardly from the associated U-arm for resiliently engaging and yieldably latching with the latching means of said shank and being resiliently yieldable relative to the associated U-arm to enable limited inward yielding of the latter U-arm independently of the free end when the latter is resiliently engaging the latching means of the shank.

* * * * *